US007380914B2

(12) United States Patent
Lebron et al.

(10) Patent No.: US 7,380,914 B2
(45) Date of Patent: Jun. 3, 2008

(54) FLUID EJECTION ASSEMBLY

(75) Inventors: Hector Jose Lebron, San Diego, CA (US); Paul Crivelli, San Diego, CA (US); Scott W. Hock, Poway, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 400 days.

(21) Appl. No.: 11/114,980

(22) Filed: Apr. 26, 2005

(65) Prior Publication Data

US 2006/0238578 A1 Oct. 26, 2006

(51) Int. Cl.
*B41J 2/05* (2006.01)

(52) U.S. Cl. ..... 347/56; 347/17; 347/18; 347/63; 347/64

(58) Field of Classification Search ..... 347/61–65, 347/67, 54, 56, 17, 18
See application file for complete search history.

(56) References Cited

U.S. PATENT DOCUMENTS

| | | | |
|---|---|---|---|
| 4,412,224 | A | 10/1983 | Sugitani |
| 4,438,191 | A | 3/1984 | Cloutier et al. |
| 4,455,560 | A | 6/1984 | Louzil |
| 4,567,493 | A | 1/1986 | Ikeda et al. |
| 4,596,994 | A | 6/1986 | Matsuda et al. |
| 4,611,219 | A | 9/1986 | Sugitani et al. |
| 4,646,110 | A | 2/1987 | Ikeda et al. |
| 4,680,595 | A | 7/1987 | Cruz-Uribe et al. |
| 4,695,854 | A | 9/1987 | Cruz-Uribe |
| 4,730,197 | A | 3/1988 | Raman et al. |
| 4,777,494 | A | 10/1988 | Shibata et al. |
| 4,823,149 | A | 4/1989 | Martner et al. |
| 4,894,664 | A | 1/1990 | Tsung Pan |
| 4,897,668 | A | 1/1990 | Nagato et al. |
| 4,905,017 | A | 2/1990 | Sugitani et al. |
| 4,929,964 | A | 5/1990 | Sato et al. |
| 4,965,594 | A | 10/1990 | Komuro |
| 5,068,674 | A | 11/1991 | Sato et al. |
| 5,132,707 | A | 7/1992 | O'Neill |
| 5,163,177 | A | 11/1992 | Komura |
| 5,165,061 | A | 11/1992 | Witteveen |
| 5,469,199 | A | 11/1995 | Allen et al. |
| 5,565,900 | A | 10/1996 | Cowger et al. |
| 5,592,203 | A | 1/1997 | Thiel et al. |
| 5,604,519 | A | 2/1997 | Keefe et al. |
| 5,610,641 | A | 3/1997 | Ikado |
| 5,622,897 | A | 4/1997 | Hayes |

(Continued)

FOREIGN PATENT DOCUMENTS

| | | |
|---|---|---|
| EP | 0067653 | 12/1982 |

(Continued)

OTHER PUBLICATIONS

WO Search Report-PCT/US004/020677, Jun. 2004, HP.

*Primary Examiner*—Matthew Luu
*Assistant Examiner*—Henok Legesse

(57) ABSTRACT

A fluid ejection assembly includes a first layer, and a second layer positioned on a side of the first layer. The second layer has a side adjacent the side of the first layer and includes barriers defining a fluid chamber on the side, a drop ejecting element formed within the fluid chamber, and a thermal conduction path extended between the fluid chamber and the barriers.

22 Claims, 10 Drawing Sheets

U.S. PATENT DOCUMENTS

| | | | | |
|---|---|---|---|---|
| 5,748,214 | A | 5/1998 | Usui et al. | |
| 5,752,303 | A | 5/1998 | Thiel | |
| 5,802,687 | A | 9/1998 | Thiel et al. | |
| 5,825,382 | A | 10/1998 | Thiel | |
| 5,880,756 | A | 3/1999 | Ishii et al. | |
| 5,883,651 | A | 3/1999 | Thiel et al. | |
| 5,956,059 | A | 9/1999 | Usui | |
| 5,969,736 | A | 10/1999 | Field et al. | |
| 6,024,440 | A | 2/2000 | Murthy et al. | |
| 6,044,646 | A | 4/2000 | Silverbrook | |
| 6,079,819 | A * | 6/2000 | Deshpande et al. | 347/65 |
| 6,135,586 | A | 10/2000 | McClelland et al. | |
| 6,155,674 | A | 12/2000 | Figueredo et al. | |
| 6,206,501 | B1 | 3/2001 | Ishii et al. | |
| 6,209,991 | B1 | 4/2001 | Regan et al. | |
| 6,281,912 | B1 | 8/2001 | Silverbrook | |
| 6,286,939 | B1 | 9/2001 | Hindman et al. | |
| 6,328,428 | B1 | 12/2001 | Keefe et al. | |
| 6,367,911 | B1 | 4/2002 | Windel et al. | |
| 6,378,991 | B1 | 4/2002 | Lim et al. | |
| 6,409,323 | B1 | 6/2002 | Silverbrook | |
| 6,457,796 | B1 | 10/2002 | Fujii | |
| 6,471,339 | B1 | 10/2002 | Kamiyama et al. | |
| 2004/0080583 | A1 * | 4/2004 | Lim et al. | 347/56 |
| 2005/0001886 | A1 * | 1/2005 | Hock et al. | 347/71 |

FOREIGN PATENT DOCUMENTS

| | | |
|---|---|---|
| EP | 1125745 | 8/2001 |
| WO | WO2005/007142 | 1/2005 |

* cited by examiner

FLUID EJECTION ASSEMBLY

CROSS-REFERENCE TO RELATED APPLICATIONS

This application is related to U.S. patent application Ser. No. 10/613,471, filed on Jul. 3, 2003, assigned to the assignee of the present invention, and incorporated herein by reference.

BACKGROUND

An inkjet printing system, as one embodiment of a fluid ejection system, may include a printhead, an ink supply which supplies liquid ink to the printhead, and an electronic controller which controls the printhead. The printhead, as one embodiment of a fluid ejection device, ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

In one arrangement, the drops of ink are developed by a firing resistor which generates heat within a fluid chamber and develops a bubble which displaces fluid that forms a drop at the orifice. Unfortunately, the heat generated with the fluid chamber may affect operation of the printhead.

SUMMARY

One aspect of the present invention provides a fluid ejection assembly. The fluid ejection assembly includes a first layer, and a second layer positioned on a side of the first layer. The second layer has a side adjacent the side of the first layer and includes barriers defining a fluid chamber on the side, a drop ejecting element formed within the fluid chamber, and a thermal conduction path extended between the fluid chamber and the barriers.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
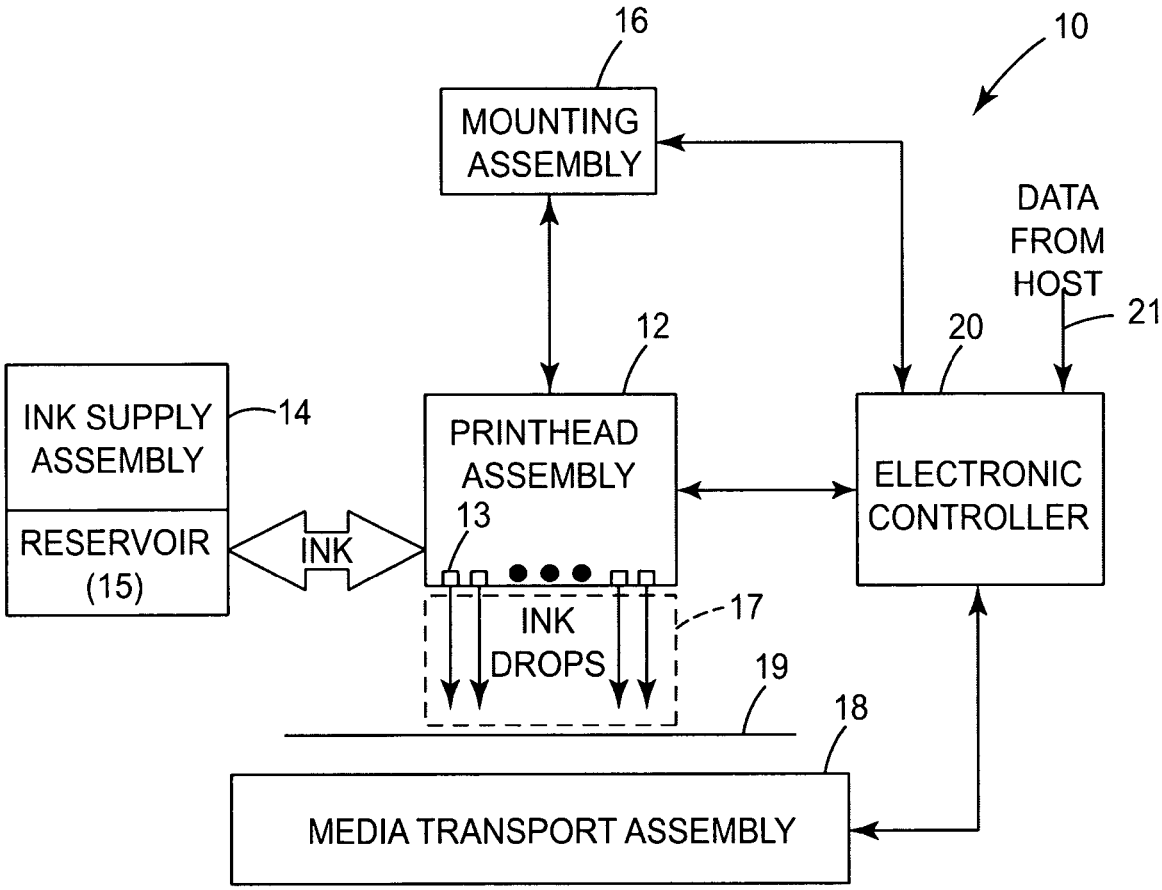
FIG. 1 is a block diagram illustrating one embodiment of an inkjet printing system according to the present invention.

FIG. 1 illustrates one embodiment of an inkjet printing system 10 according to the present invention. Inkjet printing system 10 constitutes one embodiment of a fluid ejection system which includes a fluid ejection assembly, such as a printhead assembly 12, and a fluid supply assembly, such as an ink supply assembly 14. In the illustrated embodiment, inkjet printing system 10 also includes a mounting assembly 16, a media transport assembly 18, and an electronic controller 20.

Printhead assembly 12, as one embodiment of a fluid ejection assembly, is formed according to an embodiment of the present invention and ejects drops of ink, including one or more colored inks, through a plurality of orifices or nozzles 13. While the following description refers to the ejection of ink from printhead assembly 12, it is understood that other liquids, fluids, or flowable materials, including clear fluid, may be ejected from printhead assembly 12.

In one embodiment, the drops are directed toward a medium, such as print media 19, so as to print onto print media 19. Typically, nozzles 13 are arranged in one or more columns or arrays such that properly sequenced ejection of ink from nozzles 13 causes, in one embodiment, characters, symbols, and/or other graphics or images to be printed upon print media 19 as printhead assembly 12 and print media 19 are moved relative to each other.

Print media 19 includes any type of suitable sheet material, such as paper, card stock, envelopes, labels, transparent film, cardboard, rigid panels, and the like. In one embodiment, print media 19 is a continuous form or continuous web print media 19. As such, print media 19 may include a continuous roll of unprinted paper.

Ink supply assembly 14, as one embodiment of a fluid supply assembly, supplies ink to printhead assembly 12 and includes a reservoir 15 for storing ink. As such, ink flows from reservoir 15 to printhead assembly 12. In one embodiment, ink supply assembly 14 and printhead assembly 12 form a recirculating ink delivery system. As such, ink flows back to reservoir 15 from printhead assembly 12. In one embodiment, printhead assembly 12 and ink supply assembly 14 are housed together in an inkjet or fluidjet cartridge or pen. In another embodiment, ink supply assembly 14 is separate from printhead assembly 12 and supplies ink to printhead assembly 12 through an interface connection, such as a supply tube.

Mounting assembly 16 positions printhead assembly 12 relative to media transport assembly 18, and media transport assembly 18 positions print media 19 relative to printhead assembly 12. As such, a print zone 17 within which printhead assembly 12 deposits ink drops is defined adjacent to nozzles 13 in an area between printhead assembly 12 and print media 19. Print media 19 is advanced through print zone 17 during printing by media transport assembly 18.

In one embodiment, printhead assembly 12 is a scanning type printhead assembly, and mounting assembly 16 moves printhead assembly 12 relative to media transport assembly 18 and print media 19 during printing of a swath on print media 19. In another embodiment, printhead assembly 12 is a non-scanning type printhead assembly, and mounting assembly 16 fixes printhead assembly 12 at a prescribed position relative to media transport assembly 18 during printing of a swath on print media 19 as media transport assembly 18 advances print media 19 past the prescribed position.

Electronic controller 20 communicates with printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other data or wireless data transfer path. Data 21 represents, for example, a document and/or file to be printed. As such, data 21 forms a print job for inkjet printing system 10 and includes one or more print job commands and/or command parameters.

In one embodiment, electronic controller 20 provides control of printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on printhead assembly 12. In another embodiment, logic and drive circuitry is located off printhead assembly 12.

Figure 2:
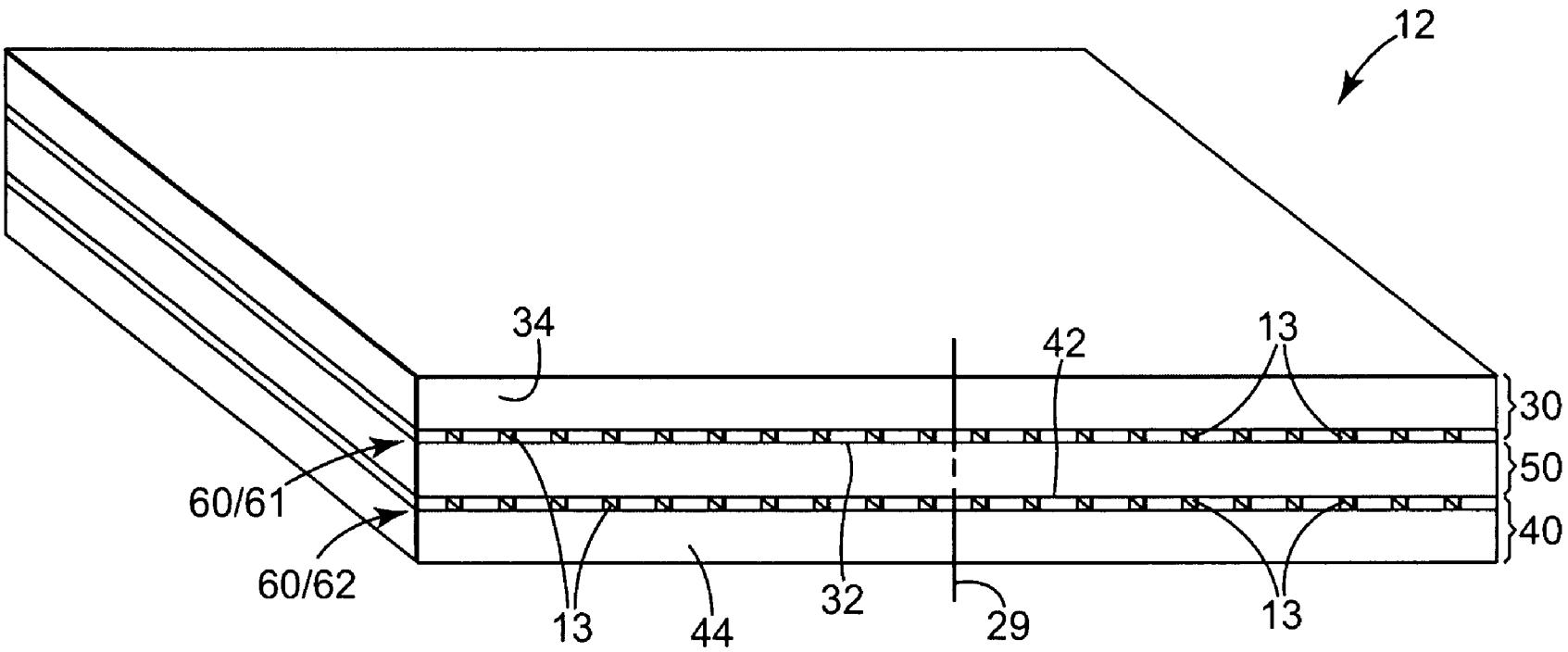
FIG. 2 is a schematic perspective view illustrating one embodiment of a printhead assembly according to the present invention.

FIG. 2 illustrates one embodiment of a portion of printhead assembly 12. In one embodiment, printhead assembly 12 is a multi-layered assembly and includes outer layers 30 and 40, and at least one inner layer 50. Outer layers 30 and 40 have a face or side 32 and 42, respectively, and an edge 34 and 44, respectively, contiguous with the respective side 32 and 42. Outer layers 30 and 40 are positioned on opposite sides of inner layer 50 such that sides 32 and 42 face inner layer 50 and are adjacent inner layer 50. As such, inner layer 50 and outer layers 30 and 40 are stacked along an axis 29.

As illustrated in the embodiment of FIG. 2, inner layer 50 and outer layers 30 and 40 are arranged to form one or more rows 60 of nozzles 13. Rows 60 of nozzles 13 extend, for example, in a direction substantially perpendicular to axis 29. As such, in one embodiment, axis 29 represents a print axis or axis of relative movement between printhead assembly 12 and print media 19. Thus, a length of rows 60 of nozzles 13 establishes a swath height of a swath printed on print media 19 by printhead assembly 12. In one exemplary embodiment, rows 60 of nozzles 13 span a distance less than approximately two inches. In another exemplary embodiment, rows 60 of nozzles 13 span a distance greater than approximately two inches.

In one exemplary embodiment, inner layer 50 and outer layers 30 and 40 form two rows 61 and 62 of nozzles 13. More specifically, inner layer 50 and outer layer 30 form row 61 of nozzles 13 along edge 34 of outer layer 30, and inner layer 50 and outer layer 40 form row 62 of nozzles 13 along edge 44 of outer layer 40. As such, in one embodiment, rows 61 and 62 of nozzles 13 are spaced from and oriented substantially parallel to each other.

In one embodiment, as illustrated in FIG. 2, nozzles 13 of rows 61 and 62 are substantially aligned. More specifically, each nozzle 13 of row 61 is substantially aligned with one nozzle 13 of row 62 along a print line oriented substantially parallel to axis 29. As such, the embodiment of FIG. 2 provides nozzle redundancy since fluid (or ink) can be ejected through multiple nozzles along a given print line. Thus, a defective or inoperative nozzle can be compensated for by another aligned nozzle. In addition, nozzle redundancy provides the ability to alternate nozzle activation amongst aligned nozzles.

Figure 3:
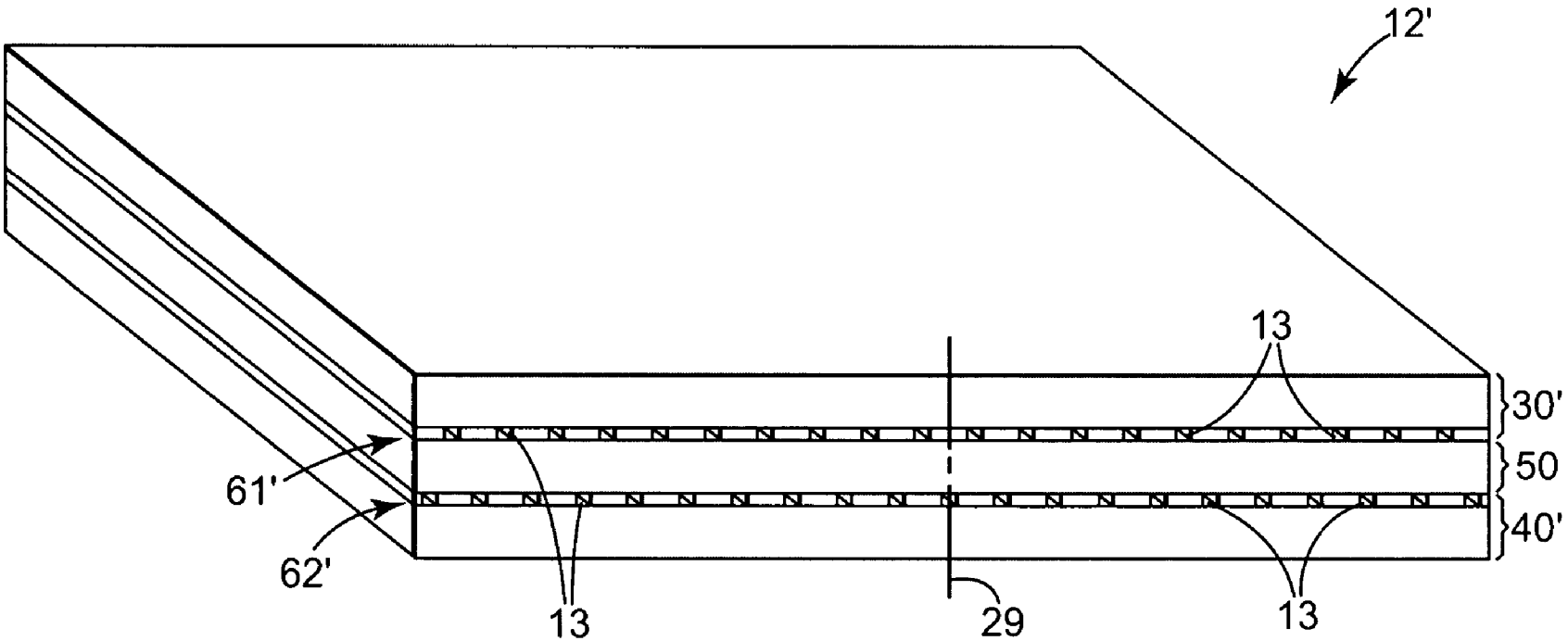
FIG. 3 is a schematic perspective view illustrating another embodiment of the printhead assembly of FIG. 2.

FIG. 3 illustrates another embodiment of a portion of printhead assembly 12. Similar to printhead assembly 12, printhead assembly 12' is a multi-layered assembly and includes outer layers 30' and 40', and inner layer 50. In addition, similar to outer layers 30 and 40, outer layers 30' and 40' are positioned on opposite sides of inner layer 50. As such, inner layer 50 and outer layers 30' and 40' form two rows 61' and 62' of nozzles 13.

As illustrated in the embodiment of FIG. 3, nozzles 13 of rows 61' and 62' are offset. More specifically, each nozzle 13 of row 61' is staggered or offset from one nozzle 13 of row 62' along a print line oriented substantially parallel to axis 29. As such, the embodiment of FIG. 3 provides increased resolution since the number of dots per inch (dpi) that can be printed along a line oriented substantially perpendicular to axis 29 is increased.

Figure 4:
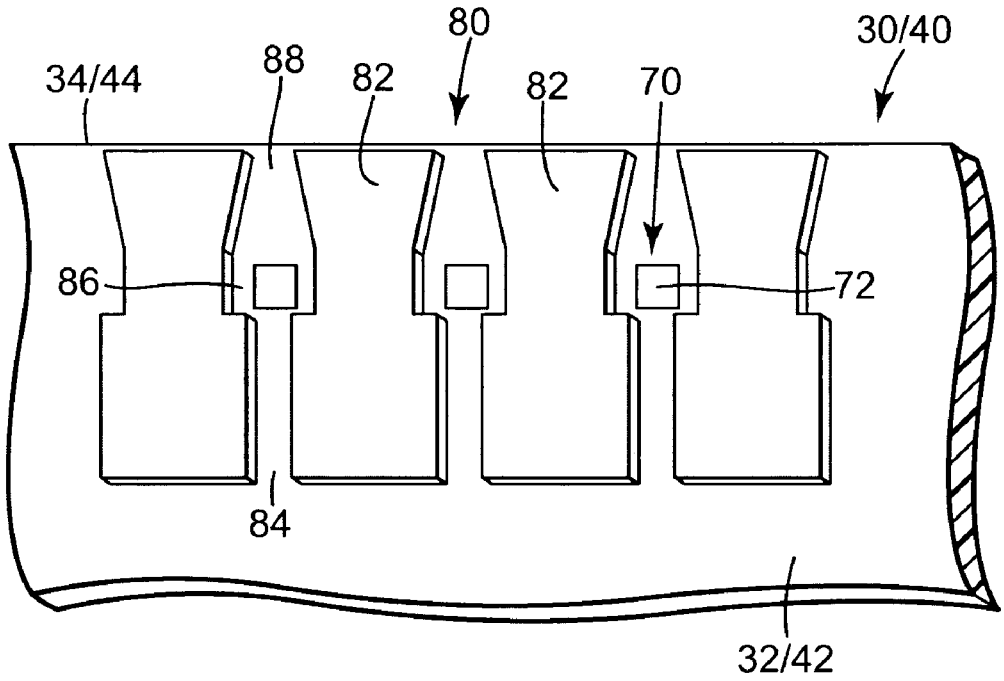
FIG. 4 is a schematic perspective view illustrating one embodiment of a portion of an outer layer of the printhead assembly of FIG. 2.

In one embodiment, as illustrated in FIG. 4, outer layers 30 and 40 (only one of which is illustrated in FIG. 4 and including outer layers 30' and 40') each include drop ejecting elements 70 and fluid pathways 80 formed on sides 32 and 42, respectively. Drop ejecting elements 70 and fluid pathways 80 are arranged such that fluid pathways 80 communicate with and supply fluid (or ink) to drop ejecting elements 70. In one embodiment, drop ejecting elements 70 and fluid pathways 80 are arranged in substantially linear arrays on sides 32 and 42 of respective outer layers 30 and 40. As such, all drop ejecting elements 70 and fluid pathways 80 of outer layer 30 are formed on a single or monolithic layer, and all drop ejecting elements 70 and fluid pathways 80 of outer layer 40 are formed on a single or monolithic layer.

In one embodiment, as described below, inner layer 50 (FIG. 2) has a fluid manifold or fluid passage defined therein which distributes fluid supplied, for example, by ink supply assembly 14 to fluid pathways 80 and drop ejecting elements 70 formed on outer layers 30 and 40.

In one embodiment, fluid pathways 80 are defined by barriers 82 formed on sides 32 and 42 of respective outer layers 30 and 40. As such, inner layer 50 (FIG. 2) and fluid pathways 80 of outer layer 30 form row 61 of nozzles 13 along edge 34, and inner layer 50 (FIG. 2) and fluid pathways 80 of outer layer 40 form row 62 of nozzles 13 along edge 44 when outer layers 30 and 40 are positioned on opposite sides of inner layer 50.

As illustrated in the embodiment of FIG. 4, each fluid pathway 80 includes a fluid inlet 84, a fluid chamber 86, and a fluid outlet 88 such that fluid chamber 86 communicates with fluid inlet 84 and fluid outlet 88. Fluid inlet 84 communicates with a supply of fluid (or ink), as described below, and supplies fluid (or ink) to fluid chamber 86. Fluid outlet 88 communicates with fluid chamber 86 and, in one embodiment, forms a portion of a respective nozzle 13 when outer layers 30 and 40 are positioned on opposite sides of inner layer 50.

In one embodiment, each drop ejecting element 70 includes a firing resistor 72 formed within fluid chamber 86 of a respective fluid pathway 80. Firing resistor 72 includes, for example, a heater resistor which, when energized, heats fluid within fluid chamber 86 to produce a bubble within fluid chamber 86 and generate a droplet of fluid which is ejected through nozzle 13. As such, in one embodiment, a respective fluid chamber 86, firing resistor 72, and nozzle 13 form a drop generator of a respective drop ejecting element 70.

In one embodiment, during operation, fluid flows from fluid inlet 84 to fluid chamber 86 where droplets of fluid are ejected from fluid chamber 86 through fluid outlet 88 and a respective nozzle 13 upon activation of a respective firing resistor 72. As such, droplets of fluid are ejected substantially parallel to sides 32 and 42 of respective outer layers 30 and 40 toward a medium. Accordingly, in one embodiment, printhead assembly 12 constitutes an edge or "side-shooter" design.

Figure 5:
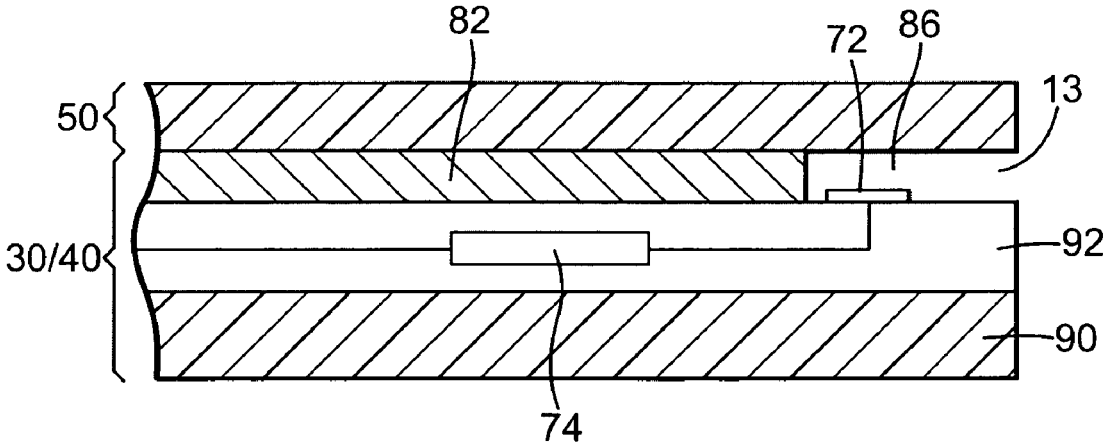
FIG. 5 is a schematic cross-sectional view illustrating one embodiment of a portion of the printhead assembly of FIG. 2.

In one embodiment, as illustrated in FIG. 5, outer layers 30 and 40 (only one of which is illustrated in FIG. 5 and including outer layers 30' and 40') each include a substrate 90 and a thin-film structure 92 formed on substrate 90. As such, firing resistors 72 of drop ejecting elements 70 and barriers 82 of fluid pathways 80 are formed on thin-film structure 92. As described above, outer layers 30 and 40 are positioned on opposite sides of inner layer 50 to form fluid chamber 86 and nozzle 13 of a respective drop ejecting element 70.

In one embodiment, inner layer 50 and substrate 90 of outer layers 30 and 40 each include a common material. As such, a coefficient of thermal expansion of inner layer 50 and outer layers 30 and 40 is substantially matched. Thus, thermal gradients between inner layer 50 and outer layers 30 and 40 are minimized. Example materials suitable for inner layer 50 and substrate 90 of outer layers 30 and 40 include glass, metal, a ceramic material, a carbon composite material, a metal matrix composite material, or any other chemically inert and thermally stable material.

In one exemplary embodiment, inner layer 50 and substrate 90 of outer layers 30 and 40 include glass such as Corning® 1737 glass or Corning® 1740 glass. In one exemplary embodiment, when inner layer 50 and substrate 90 of outer layers 30 and 40 include a metal or metal matrix composite material, an oxide layer is formed on the metal or metal matrix composite material of substrate 90.

In one embodiment, thin-film structure 92 includes drive circuitry 74 for drop ejecting elements 70. Drive circuitry 74 provides, for example, power, ground, and logic for drop ejecting elements 70 including, more specifically, firing resistors 72.

In one embodiment, thin-film structure 92 includes one or more passivation or insulation layers formed, for example, of silicon dioxide, silicon carbide, silicon nitride, tantalum, poly-silicon glass, or other suitable material. In addition, thin-film structure 92 also includes one or more conductive layers formed, for example, by aluminum, gold, tantalum, tantalum-aluminum, or other metal or metal alloy. In one embodiment, thin-film structure 92 includes thin-film transistors which form a portion of drive circuitry 74 for drop ejecting elements 70.

As illustrated in the embodiment of FIG. 5, barriers 82 of fluid pathways 80 are formed on thin-film structure 92. In one embodiment, barriers 82 are formed of a non-conductive material compatible with the fluid (or ink) to be routed through and ejected from printhead assembly 12. Example materials suitable for barriers 82 include a photo-imageable polymer and glass. The photo-imageable polymer may include a spun-on material, such as SU8, or a dry-film material, such as DuPont Vacrel®.

As illustrated in the embodiment of FIG. 5, outer layers 30 and 40 (including outer layers 30' and 40') are joined to inner layer 50 at barriers 82. In one embodiment, when barriers 82 are formed of a photo-imageable polymer or glass, outer layers 30 and 40 are bonded to inner layer 50 by temperature and pressure. Other suitable joining or bonding techniques, however, can also be used to join outer layers 30 and 40 to inner layer 50.

Figure 6:
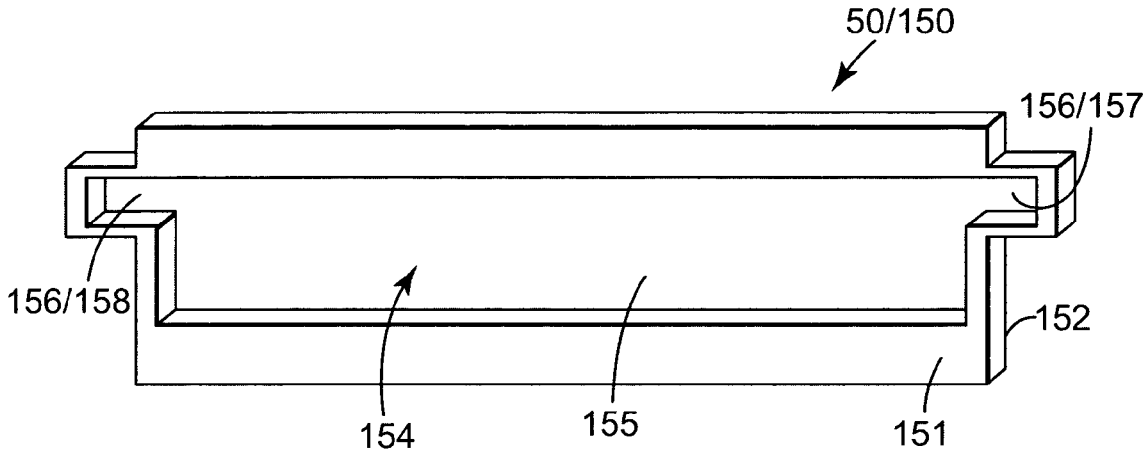
FIG. 6 is a schematic plan view illustrating one embodiment of an inner layer of the printhead assembly of FIG. 2.

In one embodiment, as illustrated in FIG. 6, inner layer 50 includes a single inner layer 150. Single inner layer 150 has a first side 151 and a second side 152 opposite first side 151. In one embodiment, side 32 (FIG. 4) of outer layer 30 is adjacent first side 151 and side 42 of outer layer 40 is adjacent second side 152 when outer layers 30 and 40 are positioned on opposite sides of inner layer 50.

In one embodiment, single inner layer 150 has a fluid passage 154 defined therein. Fluid passage 154 includes, for example, an opening 155 which communicates with first side 151 and second side 152 of single inner layer 150 and extends between opposite ends of single inner layer 150. As such, fluid passage 154 distributes fluid through single inner layer 150 and to fluid pathways 80 of outer layers 30 and 40 when outer layers 30 and 40 are positioned on opposite sides of single inner layer 150.

As illustrated in the embodiment of FIG. 6, single inner layer 150 includes at least one fluid port 156. In one exemplary embodiment, single inner layer 150 includes fluid ports 157 and 158 each communicating with fluid passage 154. In one embodiment, fluid ports 157 and 158 form a fluid inlet and a fluid outlet for fluid passage 154. As such, fluid ports 157 and 158 communicate with ink supply assembly 14 (FIG. 1) and enable circulation of fluid (or ink) between ink supply assembly 14 and printhead assembly 12.

Figure 7:
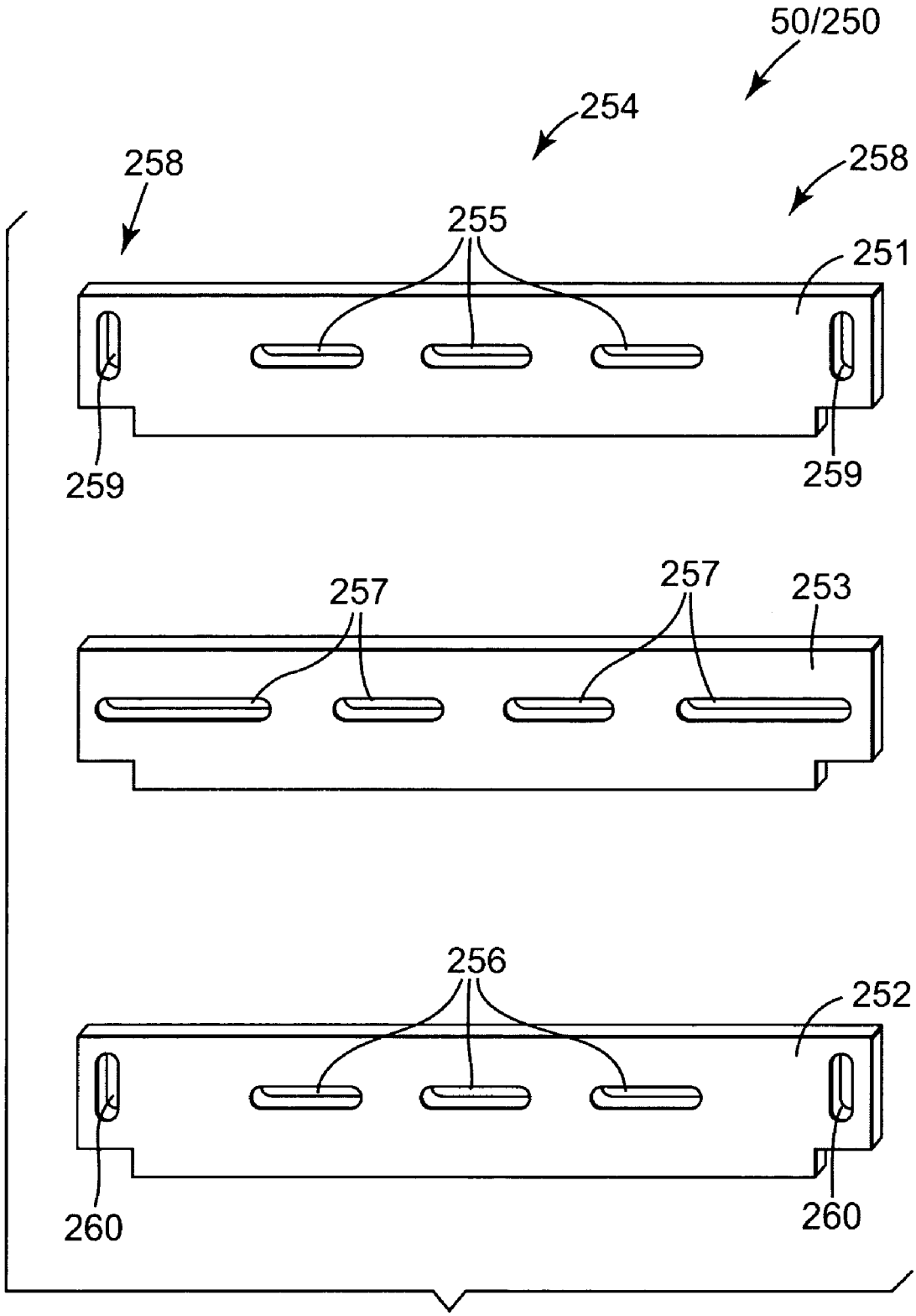
FIG. 7 is a schematic plan view illustrating another embodiment of an inner layer of the printhead assembly of FIG. 2.

In another embodiment, as illustrated in FIG. 7, inner layer 50 includes a plurality of inner layers 250. In one exemplary embodiment, inner layers 250 include inner layers 251, 252, and 253 such that inner layer 253 is interposed between inner layers 251 and 252. As such, side 32 of outer layer 30 is adjacent inner layer 251 and side 42 of outer layer 40 is adjacent inner layer 252 when outer layers 30 and 40 are positioned on opposite sides of inner layers 250.

In one exemplary embodiment, inner layers 251, 252, and 253 are joined together by glass frit bonding. As such, glass frit material is deposited and patterned on inner layers 251, 252, and/or 253, and inner layers 251, 252, and 253 are bonded together under temperature and pressure. Thus, joints between inner layers 251, 252, and 253 are thermally matched. In another exemplary embodiment, inner layers 251, 252, and 253 are joined together by anodic bonding. As such, inner layers 251, 252, and 253 are brought into intimate contact and a voltage is applied across the layers. Thus, joints between inner layers 251, 252, and 253 are thermally matched and chemically inert since no additional material is used. In another exemplary embodiment, inner layers 251, 252, and 253 are joined together by adhesive bonding. Other suitable joining or bonding techniques, however, can also be used to join inner layers 251, 252, and 253.

In one embodiment, inner layers 250 have a fluid manifold or fluid passage 254 defined therein. Fluid passage 254 includes, for example, openings 255 formed in inner layer 251, openings 256 formed in inner layer 252, and openings 257 formed in inner layer 253. Openings 255, 256, and 257 are formed and arranged such that openings 257 of inner layer 253 communicate with openings 255 and 256 of inner layers 251 and 252, respectively, when inner layer 253 is interposed between inner layers 251 and 252. As such, fluid passage 254 distributes fluid through inner layers 250 and to fluid pathways 80 of outer layers 30 and 40 when outer layers 30 and 40 are positioned on opposite sides of inner layers 250.

As illustrated in the embodiment of FIG. 7, inner layers 250 include at least one fluid port 258. In one exemplary embodiment, inner layers 250 include fluid ports 259 and 260 each formed in inner layers 251 and 252. As such, fluid ports 259 and 260 communicate with openings 257 of inner layer 253 when inner layer 253 is interposed between inner layers 251 and 252. In one embodiment, fluid ports 259 and 260 form a fluid inlet and a fluid outlet for fluid passage 254. As such, fluid ports 259 and 260 communicate with ink supply assembly 14 and enable circulation of fluid (or ink) between ink supply assembly 14 and printhead assembly 12.

In one embodiment, by forming drop ejecting elements 70 and fluid pathways 80 on outer layers 30 and 40, and positioning outer layers 30 and 40 on opposite sides of inner layer 50, as described above, printhead assembly 12 can be formed of varying lengths. For example, printhead assembly 12 may span a nominal page width, or a width shorter or longer than nominal page width. In one exemplary embodiment, printhead assembly 12 is formed as a wide-array or page-wide array such that rows 61 and 62 of nozzles 13 span a nominal page width.

In one embodiment, as described above with reference to FIG. 5, outer layers 30 and 40 each include a substrate 90 and a thin-film structure 92 formed on substrate 90. As such, firing resistors 72 of drop ejecting elements 70 and barriers 82 of fluid pathways 80 are formed on thin-film structure 92.

Figure 8:
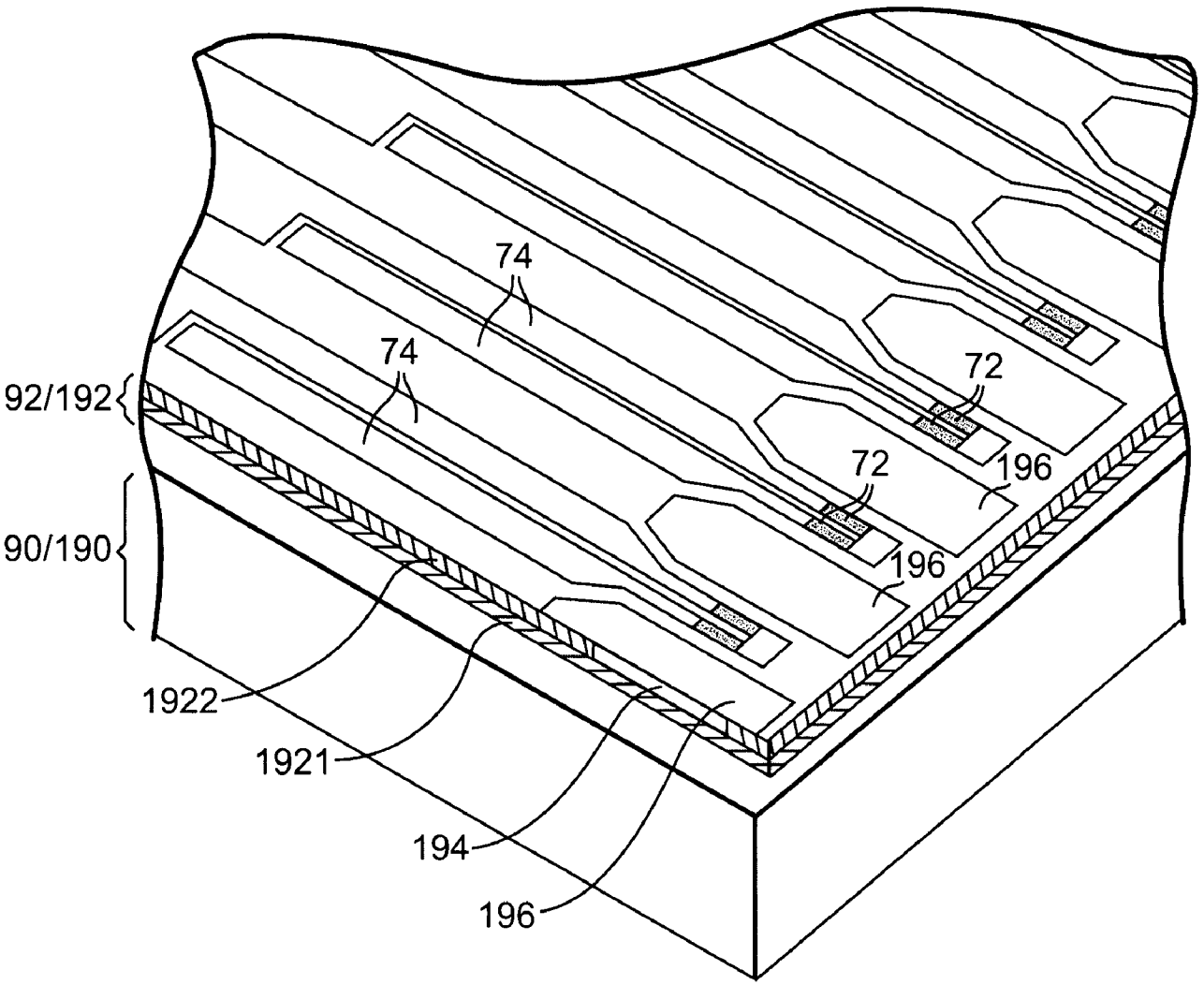
FIG. 8 is a schematic perspective view illustrating one embodiment of a substrate and a thin-film structure of a printhead assembly including a thermal conduction path.

In one embodiment, as illustrated in FIG. 8, substrate 90 includes a substrate 190 and thin-film structure 92 includes a thin-film structure 192. In one embodiment, similar to substrate 90, substrate 190 is formed of glass, metal, a ceramic material, a carbon composite material, a metal matrix composite material, or any other chemically inert and thermally stable material. In one embodiment, as described below, a thermal conduction path is defined within thin-film structure 192 for transferring heat generated by firing resistors 72 to barriers 82 (FIG. 4).

As illustrated in the embodiment of FIG. 8, thin-film structure 192 includes an electrically conductive layer 1921 and an insulative layer 1922. Electrically conductive layer 1921 is provided on a side of substrate 190 and forms a power layer or power plane for firing resistors 72. Insulative layer 1922 is formed over electrically conductive layer 1921 and prevents electrical shorts between electrically conductive materials of thin-film structure 192, such as electrically conductive layer 1921 and trace routing 74, and firing resistors 72.

In one embodiment, as illustrated in FIG. 8, thermal vias 194 (only one of which is illustrated in FIG. 8) are formed through insulative layer 1922 to electrically conductive layer 1921. In addition, thermal pads 196 are formed on insulative layer 1922 and over thermal vias 194. As such, thermal pads 196 contact and communicate with thermal vias 194 which in turn contact and communicate with electrically conductive layer 1921 through insulative layer 1922. In one embodiment, thermal vias 194 and thermal pads 196 form a portion of a thermal conduction path, as described below.

Figure 9A:
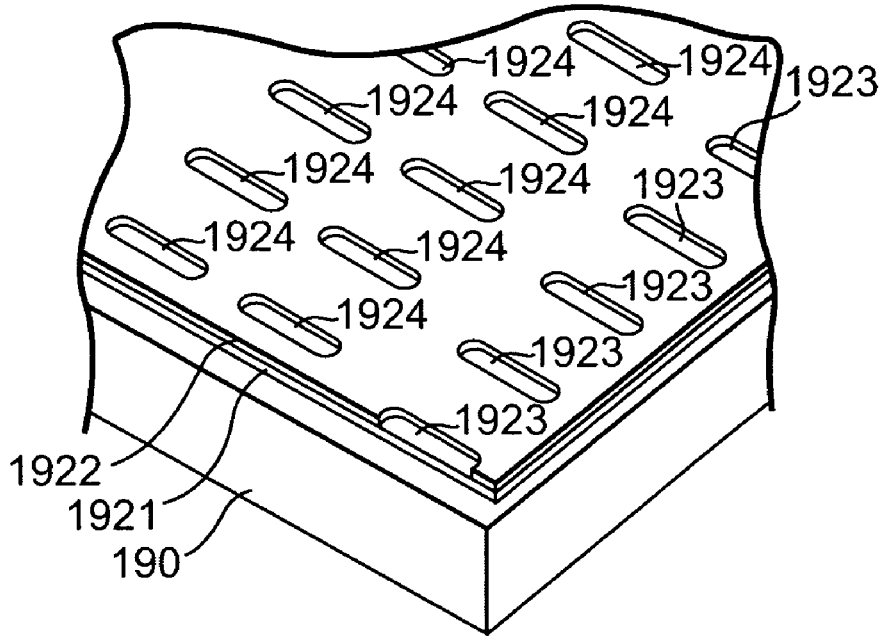
FIGS. 9A, 9B, and 9C are schematic perspective views illustrating one embodiment of forming the thin-film structure of FIG. 8.
Figure 9B:
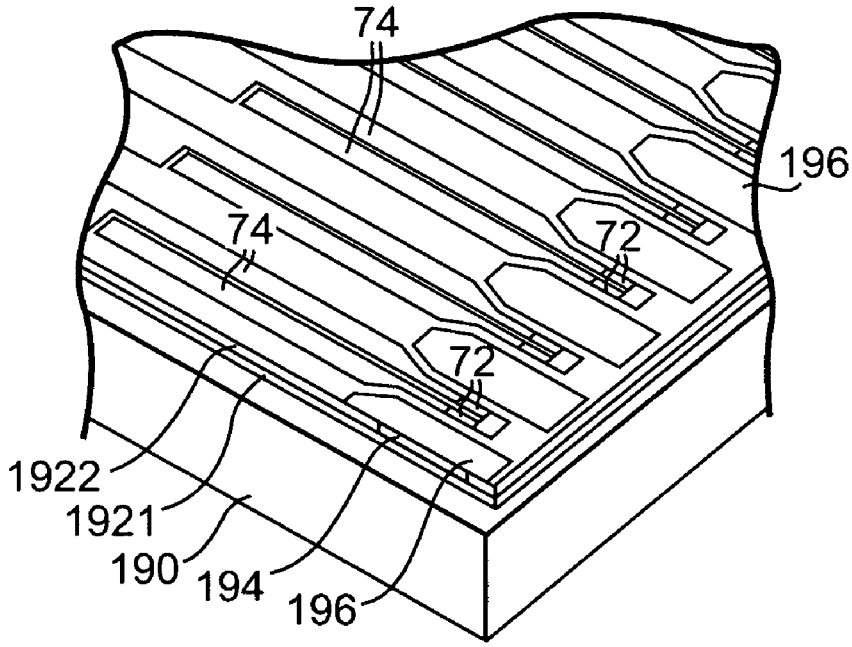
Figure 9C:
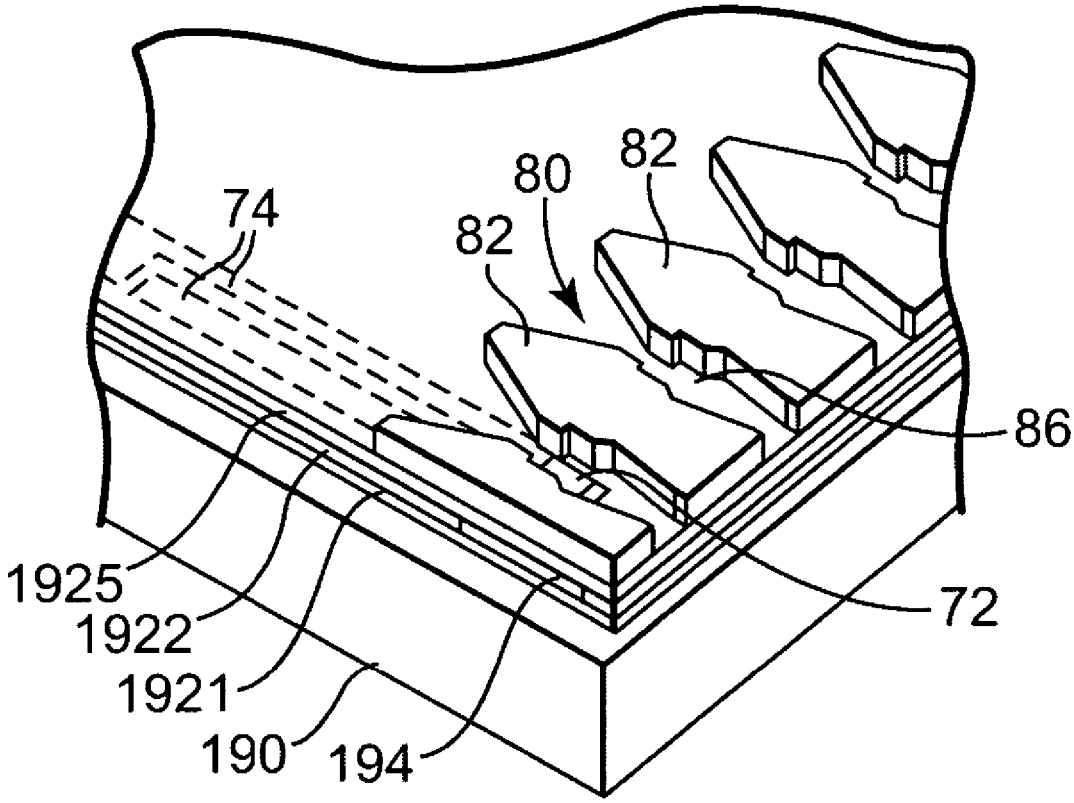

FIGS. 9A, 9B, and 9C illustrate one embodiment of forming outer layers 30 and/or 40, including forming thermal vias 194 and thermal pads 196. As illustrated in the embodiment of FIG. 9A, electrically conductive layer 1921 is formed on a side of substrate 190 and insulative layer 1922 is formed over electrically conductive layer 1921. In addition, holes 1923 for forming thermal vias 194 (FIG. 8) and holes 1924 for forming electrical vias (not shown) of thin film structure 192 are formed in insulative layer 1922. In one embodiment, holes 1923 and 1924 extend through insulative layer 1922 to electrically conductive layer 1921. Also, in one embodiment, a base layer formed, for example, of polysilicon is first formed on the side of substrate 190 with electrically conductive layer 1921 being formed over the base layer.

In one embodiment, electrically conductive layer 1921 is formed, for example, of an electrically conductive material such as aluminum. In addition, insulative layer 1922 is formed, for example, of an insulative material such as silicon dioxide; silicon carbide, silicon nitride, or other suitable material. Holes 1923 and 1924 for thermal vias 194 and electrical vias (not shown), respectively, are formed in insulative layer 1922 using, for example, photolithography techniques.

As illustrated in the embodiment of FIG. 9B, thermal vias 194 are formed in holes 1923 of insulative layer 1922, and thermal pads 196 are formed on insulative layer 1922 and over thermal vias 194. In addition, firing resistors 72 of drop ejecting elements 70 are formed on insulative layer 1922 and trace routing 74 for firing resistors 72 is formed on insulative layer 1922. Also, electrical vias (not shown) are formed in holes 1924 of insulative layer 1922.

Accordingly, in the embodiment of FIG. 9B, thermal vias 194 contact and communicate with electrically conductive layer 1921 and contact and communicate with thermal pads 196. In addition, the electrical vias through insulative layer 1922 contact and communicate with electrically conductive layer 1921 and contact and communicate with trace routing 74. As such, thermal vias 194 and thermal pads 196 provide a thermal path from electrically conductive layer 1921 through insulative layer 1922, and the electrical vias provide an electrical path from electrically conductive layer 1921 to trace routing 74 and firing resistors 72.

In one embodiment, thermal vias 194 and thermal pads 196 are formed of a thermally conductive material such as aluminum. In addition, trace routing 74 and the electrical vias formed in holes 1924 are formed of an electrically conductive material such as aluminum. Furthermore, firing resistors 72 are formed of one or more conductive layers including, for example, aluminum, gold, tantalum, tantalum-aluminum, or other metal or metal-alloy.

As illustrated in the embodiment of FIG. 9C, a passivation layer 1925 is formed over insulative layer 1922, thermal pads 196, firing resistors 72, and trace routing 74. As thermal vias 194 communicate with electrically conductive layer 1921 and thermal pads 196 communicate with thermal vias 194, passivation layer 1925 prevents electrical shorts between trace routing 74, firing resistors 72, and thermal pads 196. In one embodiment, passivation layer 1925 is formed, for example, of a thermally conductive material such as silicon carbide, silicon nitride, or tantalum.

Also, as illustrated in the embodiment of FIG. 9C, barriers 82 are formed on passivation layer 1925. Barriers 82 are positioned over respective thermal pads 196 (FIG. 9B) and form fluid pathways 80 with fluid chambers 86, as described above. In one embodiment, as described above, barriers 82 are formed of a thermally conductive and electrically non-conductive material such as a photo-imageable polymer or glass, or are formed of a thermally and electrically conductive material such as a deposited metal.

Figure 10:
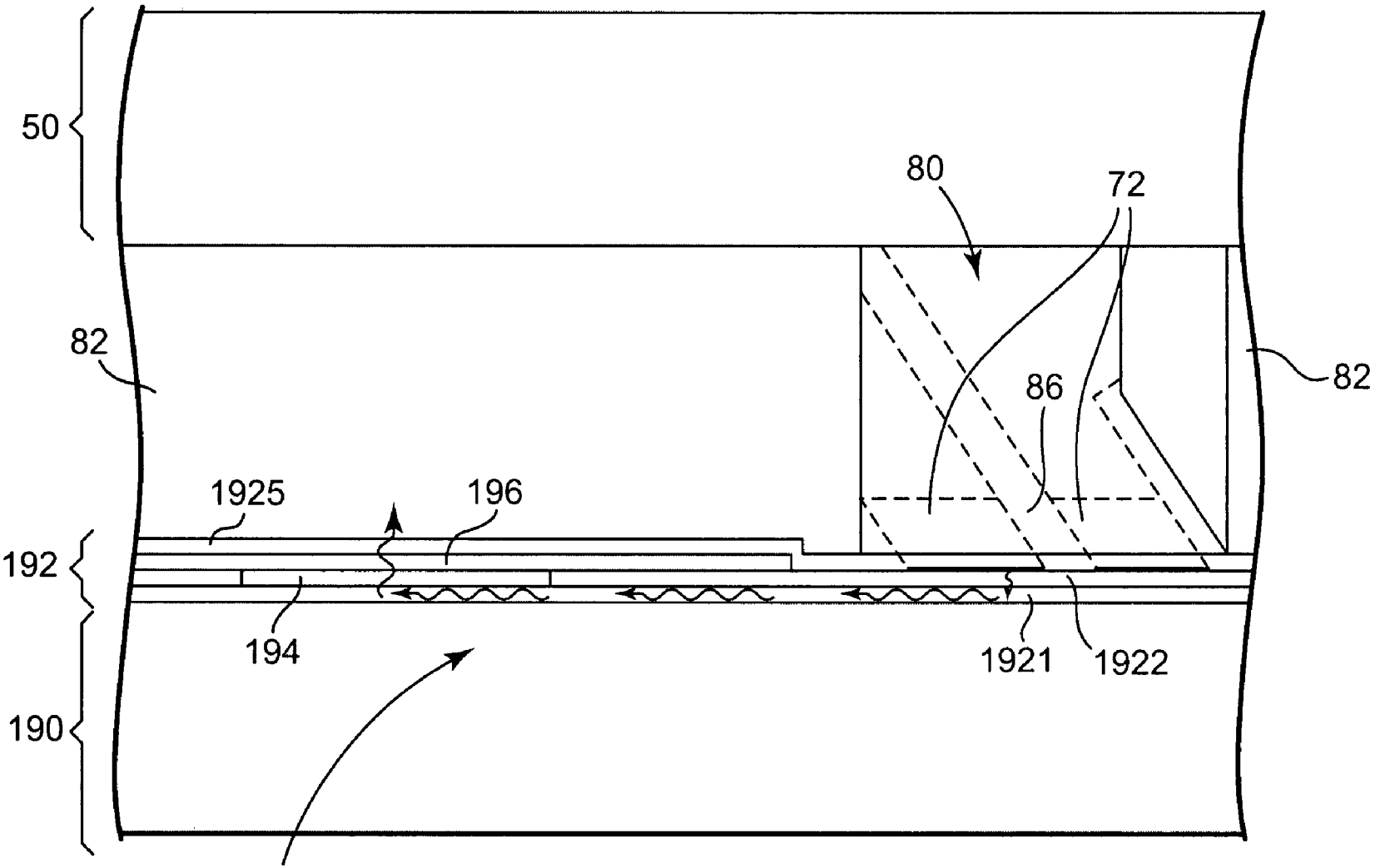
FIG. 10 is a schematic perspective view illustrating one embodiment of a thermal conduction path for a printhead assembly.

In one embodiment, as illustrated in FIG. 10, printhead assembly 12 includes a thermal conduction path 198. Thermal conduction path 198 is formed between fluid chamber 86 and barriers 82 and provides a path for transferring heat generated by firing resistors 72 within fluid chamber 86 to the material of barriers 82. In one embodiment, thermal conduction path 198 is formed within thin-film structure 192. More specifically, in one embodiment, electrically conductive layer 1921, thermal vias 194, and thermal pads 196 of thin-film structure 192 form portions of thermal conduction path 198, as described below.

In one embodiment, electrically conductive layer 1921, insulative layer 1922, and passivation layer 1925, thermal vias 194 and thermal pads 196, and barriers 82 are each formed of a thermally conductive material. As such, heat generated by firing resistor 72 within fluid chamber 86 propagates through insulative layer 1922 toward substrate 190 to electrically conductive layer 1921. The heat then follows electrically conductive layer 1921 to thermal via 194.

At thermal via 194, the heat moves through thermal via 194 to thermal pad 196. As such, thermal pad 196 spreads the heat out over the area thereof. Thereafter, the heat propagates through passivation layer 1925 to barriers 82. At barriers 82, the heat is dissipated throughout the material thereof.

In one embodiment, with barriers 82 defining fluid pathways 80 and with fluid (or ink) flowing through fluid pathways 80, heat is transferred from barriers 82 to the fluid (or ink) fed through fluid pathways 80 and ejected from fluid chamber 86. Accordingly, with thermal conduction path 198, the build-up of heat within fluid chamber 86 is mitigated. In addition, by forming barriers 82 as separate features or "islands" as illustrated, for example, in the embodiment of FIG. 9C, heat transfer from barriers 82 to the fluid (or ink) fed through fluid pathways 80 may occur along three sides of barriers 82 thereby enhancing the heat transfer.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid ejection assembly, comprising:

a first layer; and a second layer positioned on a side of the first layer, the second layer having a side adjacent the side of the first layer and including an electrically conductive layer formed on the side, an insulative layer formed over the electrically conductive layer, spaced barriers defining a fluid chamber on the side, a drop ejecting element formed within the fluid chamber, and thermal conduction paths extended between the fluid chamber and the spaced barriers, wherein the thermal conduction paths include thermal pads formed on the insulative layer, and thermal vias communicated with a respective one of the thermal pads and extended through the insulative layer to the electrically conductive layer, and wherein each of the spaced barriers is formed over a respective one of the thermal pads.

2. The fluid ejection assembly of claim 1, wherein the first layer has a fluid passage defined therein, wherein the fluid chamber of the second layer communicates with the fluid passage of the first layer.

3. The fluid ejection assembly of claim 1, wherein the drop ejecting element is adapted to eject drops of fluid substantially parallel to the side of the second layer.

4. The fluid ejection assembly of claim 1, wherein the drop ejecting element includes a firing resistor formed within the fluid chamber.

5. The fluid ejection assembly of claim 1, wherein the first layer and the second layer each include a common material, wherein the common material includes one of glass, a ceramic material, a carbon composite material, metal, and a metal matrix composite material.

6. The fluid ejection assembly of claim 1, wherein the barriers are formed of one of a photo-imageable polymer, glass, and a deposited metal.

7. The fluid ejection assembly of claim 1, wherein the thermal conduction paths are adapted to transfer heat from the fluid chamber to the barriers.

8. The fluid ejection assembly of claim 1, wherein the thermal conduction paths further include a portion of the electrically conductive layer formed under the fluid chamber.

9. The fluid ejection assembly claim 1, wherein the thermal vias are formed of a thermally conductive material.

10. The fluid ejection assembly of claim 1, wherein the thermal pads are formed of a thermally conductive material.

11. A fluid ejection device, comprising:

spaced barriers defining a fluid chamber;

a drop ejecting element formed within the fluid chamber; and means for transferring heat from the fluid chamber to the spaced barriers, the means for transferring heat including an electrically conductive layer, thermal vias extended through an insulative layer formed over the electrically conductive layer to the electrically conductive layer, and thermal pads formed over the insulative layer and communicated with a respective one of the thermal via, wherein each of the spaced barriers is positioned over a respective one of the thermal pads.

12. The fluid ejection device of claim 11, further comprising:

means for routing fluid to the fluid chamber.

13. The fluid ejection device of claim 11, wherein the drop ejecting element is adapted to eject drops of fluid in a direction substantially parallel to a surface of the drop ejecting element.

14. The fluid ejection device of claim 11, wherein the drop ejecting element includes a firing resistor formed within the fluid chamber.

15. The fluid ejection device of claim 11, wherein the barriers are formed of one of a photo-imageable polymer, glass, and a deposited metal.

16. The fluid ejection device of claim 11, further comprising:

a substrate; and a thin-film structure formed on the substrate, the thin-film structure including the electrically conductive layer and the insulative layer formed over the electrically conductive layer, wherein the barriers and the drop ejecting element are formed on the thin-film structure.

17. A method of operating a fluid ejection assembly, the method comprising:

routing fluid to a fluid chamber defined by spaced barriers formed on a side of a substrate;

ejecting drops of the fluid with a drop ejecting element communicated with the fluid chamber, including generating heat within the fluid chamber; and transferring the heat from the fluid chamber along the side of the substrate and to the spaced barriers, including transferring the heat along an electrically conductive layer formed on the side of the substrate, through thermal vias communicated with the electrically conductive layer and formed through an insulative layer formed over the electrically conductive layer, and to thermal pads formed on the insulative layer and communicated with a respective one of the thermal vias, wherein each of the spaced barriers is positioned over a respective one of the thermal pads.

18. The method of claim 17, wherein ejecting drops of the fluid includes ejecting drops substantially parallel to the side of the substrate.

19. The method of claim 17, wherein the drop ejecting element includes a firing resistor formed within the fluid chamber.

20. The method of claim 17, wherein transferring the heat further includes transferring the heat along the electrically conductive layer under the fluid chamber.

21. The method of claim 17, wherein transferring the heat further includes transferring the heat from the respective one of the thermal pads to a respective one of the spaced barriers positioned over the respective one of the thermal pads.

22. The method of claim 17, wherein transferring the heat further includes transferring the heat from the barriers to the fluid.

* * * * *

UNITED STATES PATENT AND TRADEMARK OFFICE

CERTIFICATE OF CORRECTION

PATENT NO. : 7,380,914 B2
APPLICATION NO. : 11/114980
DATED : June 3, 2008
INVENTOR(S) : Hector Jose Lebron et al.

It is certified that error appears in the above-identified patent and that said Letters Patent is hereby corrected as shown below:

In column 10, line 29, in Claim 9, after "assembly" insert -- of --.

In column 10, line 44, in Claim 11, delete "via" and insert -- vias --, therefor.

Signed and Sealed this

Second Day of September, 2008

JON W. DUDAS
*Director of the United States Patent and Trademark Office*